US007967344B2

(12) United States Patent
Herren

(10) Patent No.: US 7,967,344 B2
(45) Date of Patent: Jun. 28, 2011

(54) PORTABLE BALLOON TYING DEVICE, STATION AND CADDY

(76) Inventor: Gerald R. Herren, Baxter, TN (US)

( * ) Notice: Subject to any disclaimer, the term of this patent is extended or adjusted under 35 U.S.C. 154(b) by 43 days.

(21) Appl. No.: 12/524,599

(22) PCT Filed: Feb. 7, 2008

(86) PCT No.: PCT/US2008/053244

§ 371 (c)(1),
(2), (4) Date: Oct. 17, 2009

(87) PCT Pub. No.: WO2008/100760

PCT Pub. Date: Aug. 21, 2008

(65) Prior Publication Data

US 2010/0038906 A1 Feb. 18, 2010

Related U.S. Application Data

(60) Provisional application No. 60/890,478, filed on Feb. 17, 2007.

(51) Int. Cl.
*D03J 3/00* (2006.01)

(52) U.S. Cl. ..... 289/17

(58) Field of Classification Search ..... 289/2, 13, 289/15, 17, 18.1
See application file for complete search history.

(56) References Cited

U.S. PATENT DOCUMENTS 5,568,950 A * 10/1996 Herren ..... 289/17
5,820,169 A * 10/1998 Butler et al. ..... 289/2
6,273,479 B1 * 8/2001 Carlson ..... 289/17
6,902,212 B1 * 6/2005 Mize ..... 289/17

* cited by examiner

*Primary Examiner* — Shaun R Hurley
(74) *Attorney, Agent, or Firm* — Kirk A. Wilson

(57) ABSTRACT

A balloon tying device has a base adapted for attaching to a support structure. A cantilever, supported by the base and protruding away from the support structure, is attached to the base. The cantilever has a U-shaped cross section and two ears defining generally parallel planes extending outwardly and terminating at the tip for retaining a loop of balloon material. Inside the U-shape of the cantilever is an axially oriented recess for passing ribbon and providing clearance for tucking the overhand knot. A brace tab extends downward from the lower edge of the base. A ribbon retainer is disposed on the device for integrating spooled or pre-cut ribbon into the balloon knot. The support structure can be human fingers, a station stanchion, a tank stand, or a caddy leg.

12 Claims, 20 Drawing Sheets

PORTABLE BALLOON TYING DEVICE, STATION AND CADDY

CROSS-REFERENCE TO RELATED APPLICATIONS

This application claims priority from U.S. Provisional Patent 60/890,478 filed Feb. 17, 2007. This application is also related to U.S. Pat. No. 5,568,950, issued Oct. 28, 1996.

TECHNICAL FIELD

This invention relates to devices that aid in tying knots and more particularly to portable devices with support structures to aid in hand-tying half-hitch knots, especially in balloons and the like. Spooled and pre-cut ribbon can be tied integral with the knot. A tying station, tank stand and caddy to support and transport the devices are also taught.

BACKGROUND OF THE INVENTION

Balloons with ribbons and the like are generally tied with a half-hitch knot. First, a loop is made in the balloon tail, passing the end over the standing part, then passing the end under the standing part and through the loop. See The World Book Dictionary, Clarence L. Barnhart and Robert K. Barnhart, editors, World Book, Inc., publisher, 1990, page 956, column 3. The loop is usually made around one or more fingers, which has disadvantages, among which are: 1. Difficulty of passing the end through the loop, because the material is generally kept very tight to prevent air or gas from escaping from the balloon; 2. Damage to the material while tying the knot therein; 3. Fatigue of the hands, especially the fingers, due to tying many balloons; 4. Extra time is often required to avoid or cope with the above listed disadvantages.

There are various commercially available devices which can be attached to the open ends of balloons to seal the air or gas there inside. Such products do not relate to the invention because when such devices are removed from the balloon, the air or gas escapes therefrom.

Other devices, such as that disclosed by Peverley in U.S. Pat. No. 4,989,906, issued on Feb. 5, 1991, attach to fixed support means via a bracket. Such devices are not generally portable since they must be secured to a fixed support. There is a need for a balloon tying device which can be held in the hand or positioned on a stanchion while operated with both hands to facilitate easy tying of balloons.

See also: U.S. Pat. No. 5,314,217 to Place, issued on May 24, 1994; U.S. Pat. No. 5,039,142 to Muma, issued on Aug. 13, 1991; U.S. Pat. No. 4,864,762 to Cox, issued on Sep. 12, 1989; U.S. Pat. No. 4,029,346 to Browning, issued on Jun. 14, 1977; U.S. Pat. No. 3,837,691 to Smythe, issued on Sep. 24, 1974; and U.S. Pat. No. 1,008,190 to O'Connell, issued on Nov. 7, 1911.

BRIEF SUMMARY OF THE INVENTION

In accordance with one aspect of the present invention, the foregoing and other objects are achieved by a balloon tying device having a base adapted for attaching to a support structure. A cantilever, supported by the base and protruding away from the support structure, is attached to the base. The cantilever has a U-shaped cross section, a proximal region closest to the base and a distal region. The proximal region has two ears defining generally parallel planes extending outwardly; each of the ears terminates in a distal retaining edge for retaining a loop of balloon material. Inside the U-shape of the cantilever is an axially oriented recess extending from the proximal region and between the ears to the distal region. A brace tab extends downward from the lower edge of the base.

A ribbon retainer is disposed on the device. The ribbon retainer has a proximal ribbon retaining section and a distal ribbon retaining section.

DETAILED DESCRIPTION OF THE INVENTION

Figure 1:
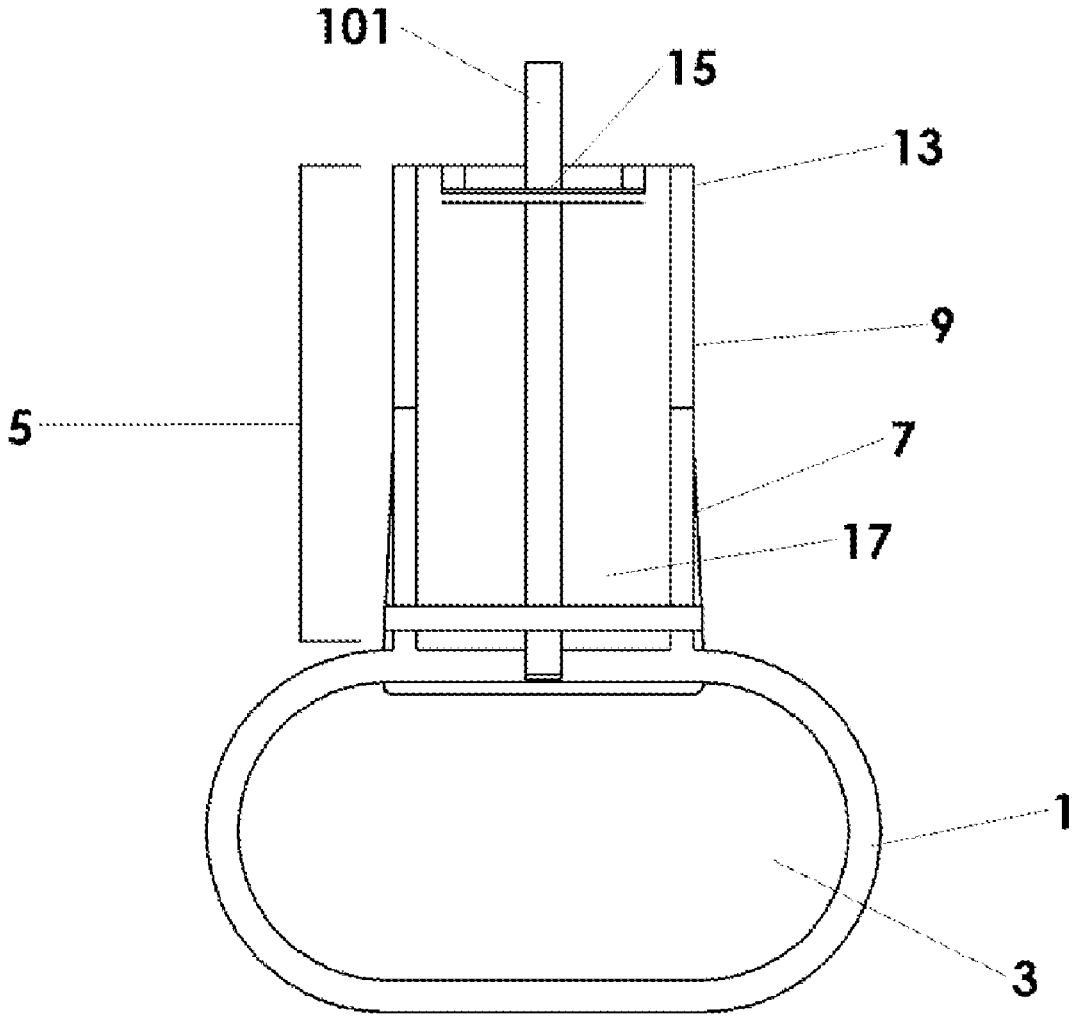
FIG. 1 is a front view of a first embodiment of the invention.
Figure 2:
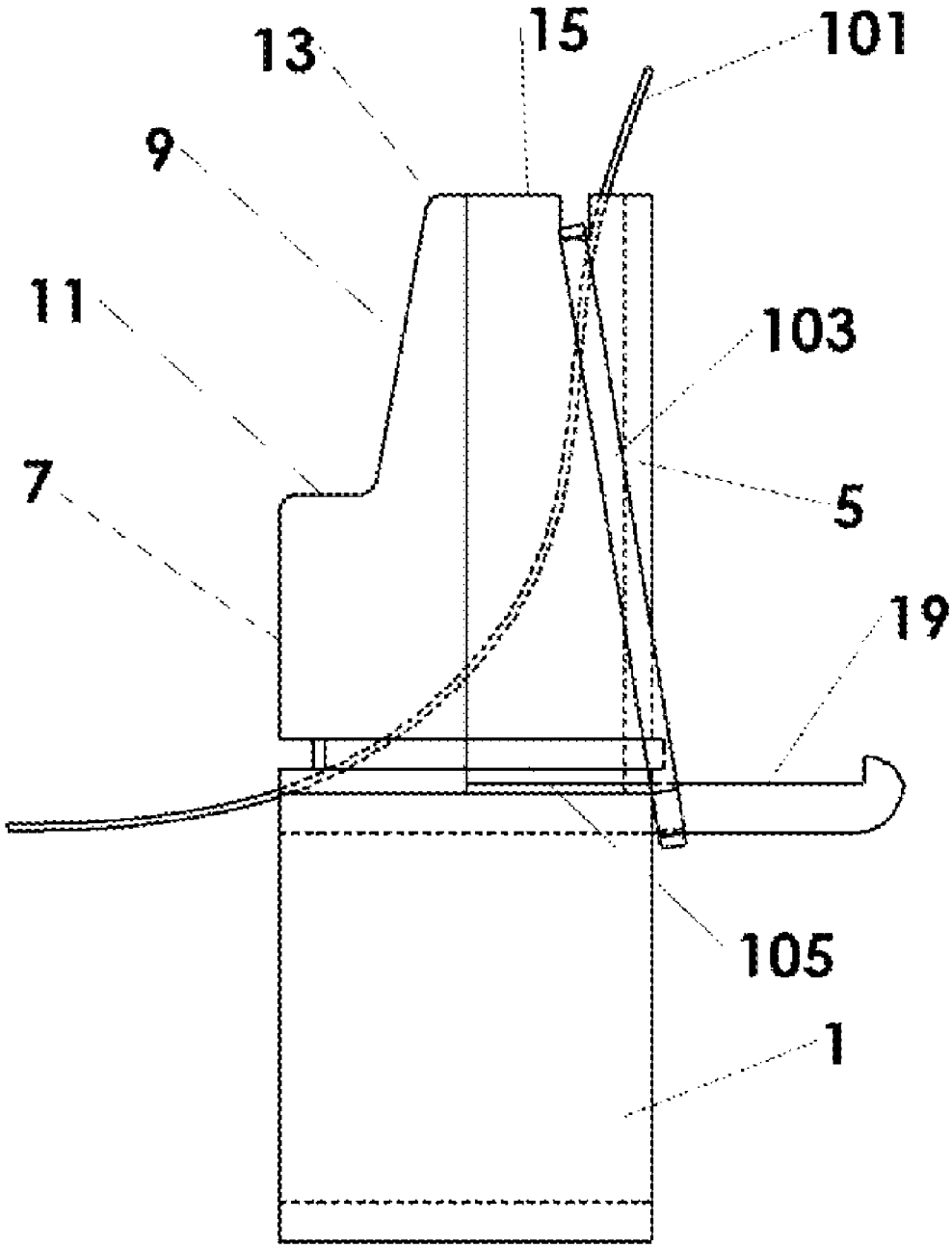
FIG. 2 is a side view of the first embodiment of the invention.
Figure 3:
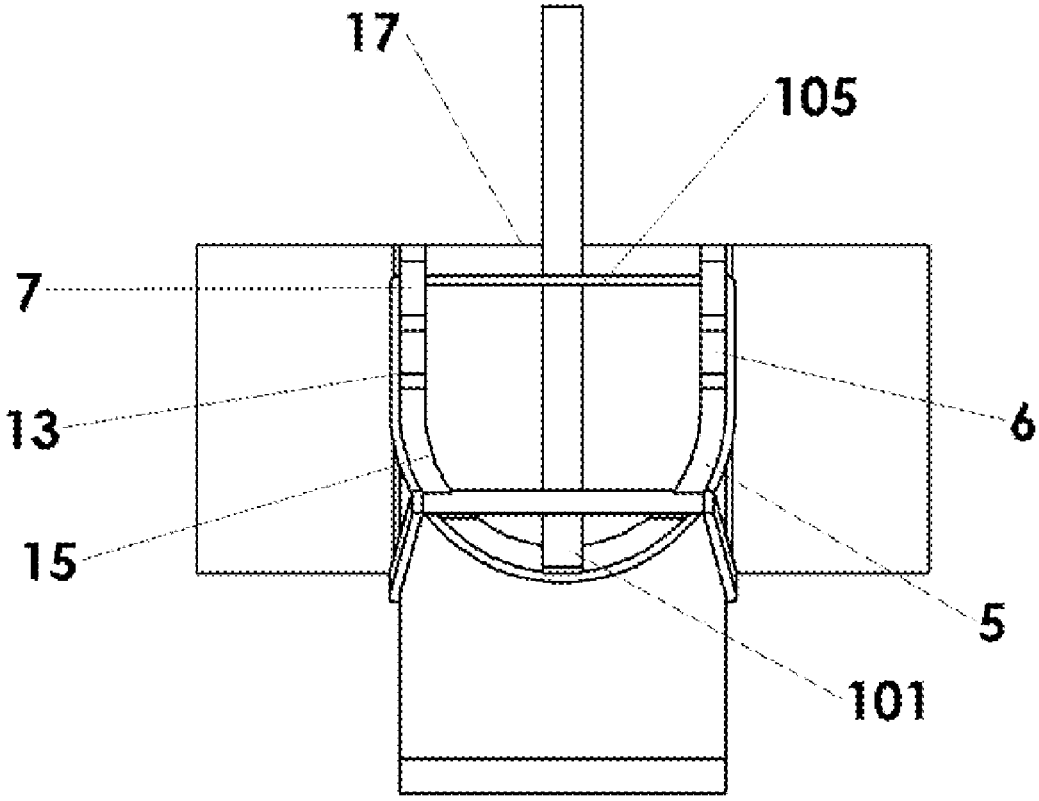
FIG. 3 is a top view of the first embodiment of the invention.
Figure 4:
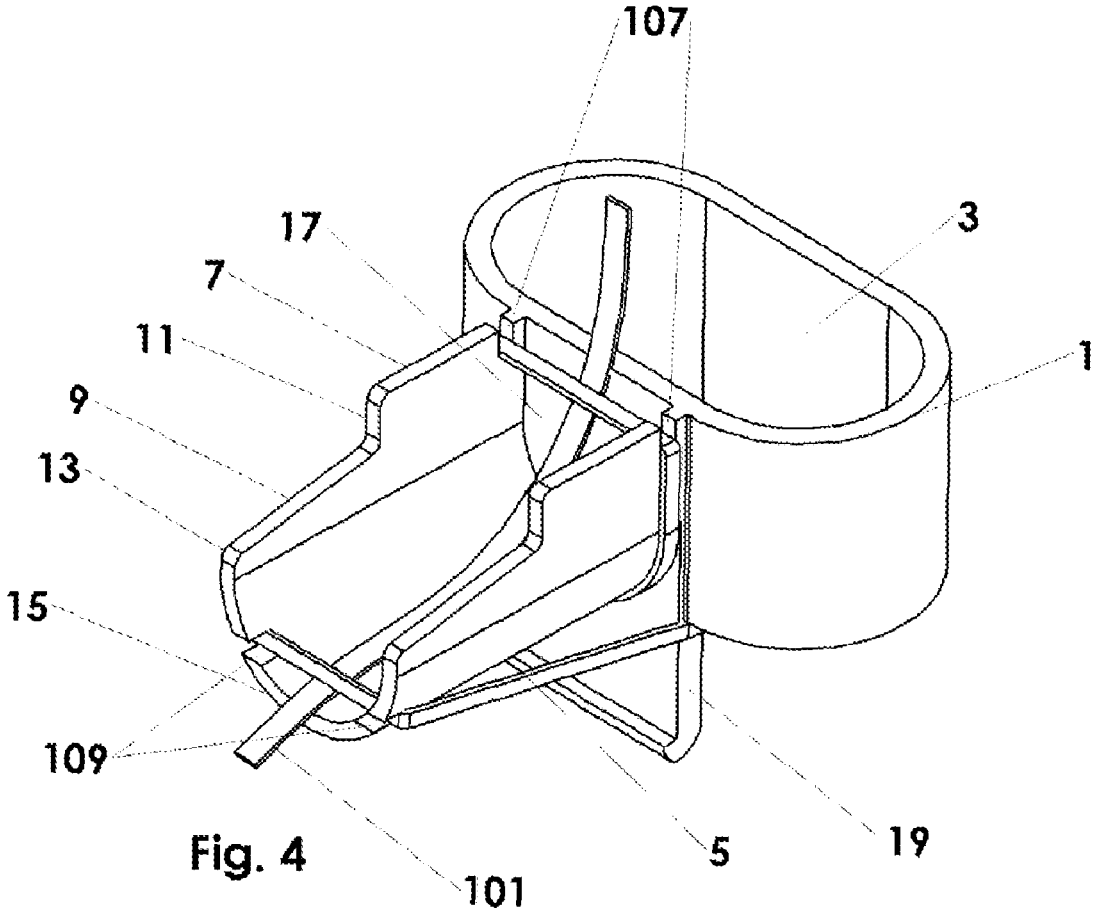
FIG. 4 is an isometric view of the first embodiment of the invention.

Referring to FIGS. 1-4, one embodiment of the invention includes a base 1 which supports a cantilever 5. The base 1 is hollow as shown, having an opening 3 to assist in mounting to a support structure. The support structure can be fingers, preferably first and second fingers, or a stanchion in a tying station, or a tank stand, or a caddy leg, or a waist belt device.

The cantilever 5 has a U-shaped cross section. Proximal to the base 1, each side of the cantilever has an ear 7 which terminates in a retaining edge 11. The two ears 7 and two retaining edges 11 are generally parallel due to the U-shape of the cantilever 5. The purpose of the retaining edges 11 is to keep the balloon tying operation sufficiently above the hand to allow sufficient clearance for manipulation of the balloon with the other hand.

Above each ear 7 is a preferably slightly back slanted holding edge 9 which extends to the end 15 of the cantilever 5. Near the end 15, the holding edge 9 preferably has a radius 13 for ensuring that the balloon is not damaged upon removal from the device. The purpose of the holding edges 9 is to provide an opening there between to allow sufficient clearance for manipulation of the balloon through the opening with the other hand. The back slanting is for facilitating easy removal of a tied balloon.

An axially oriented recess 17 extends from the base and between the ears 7 and holding edges 9 to the end 15 for proving an opening through which a finger of the other hand can push the end of a balloon in order to complete a knot. The recess 17 should therefore be at least ⅝ inch wide, and preferably ¾ inch wide to fit most normal sized human fingers.

Spooled ribbon 101 or pre-cut ribbon 102 is routed through the axially oriented recess 17 and positioned to rest in the center opening of knot such that when the knot is cinched, the ribbon passes through the core of the knot thereby making the ribbon integral with the knot. This enables construction of a balloon arch on a continuous ribbon and also allows individual ribbons to be cut for each balloon. All embodiments of the invention can integrate either a single ribbon or multiple ribbons of the same color or different colors in the balloon knot.

Proximal ribbon retainer 103 and distal ribbon retainer 105 are positioned in ribbon retainer slots 107 and 109 such that the spooled ribbon 101 remains positioned in the lower quadrant of the axially oriented recess 17 thereby allowing easy access for fingers during tying.

A brace tab 19 preferably extends downward from the base 1 to rest on a portion of the support structure to stabilize the tying device. Many, if not all, corners and edges of the device are preferably rounded or curled as shown in the drawings to ensure comfort and ease of use.

The device is preferably constructed of plastic, and is preferably fabricated by injection molding and snap assembled. However, any suitable conventional material can be used, and any suitable conventional fabrication means can be used.

Figure 5:
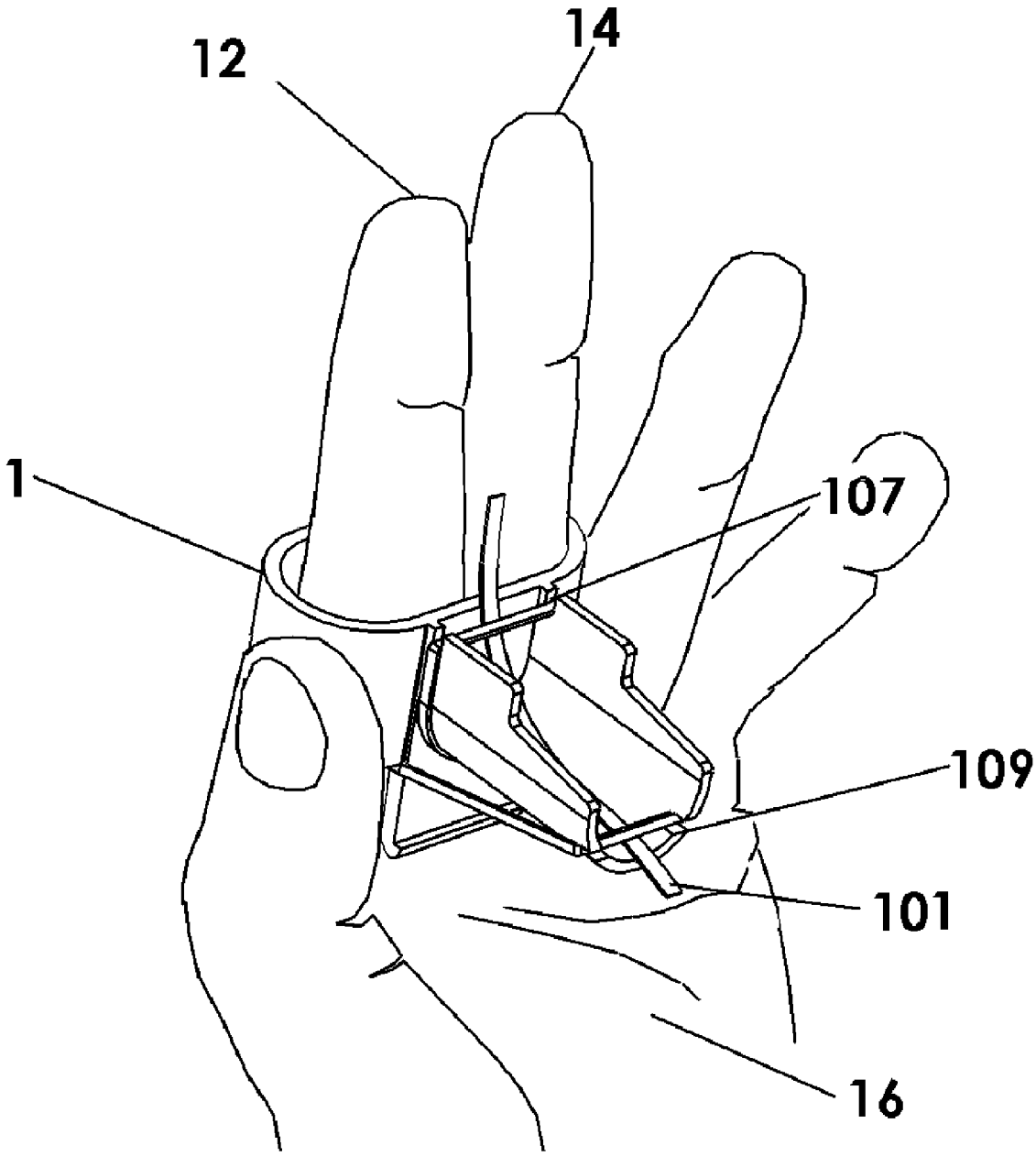
FIGS. 5-8 show four sequential steps in a method of using the invention to tie a knot in a balloon.

The device can be used to tie a knot in any material which can be wrapped around the cantilever and passed through the recess 17. A preferred method of using the device is illustrated in sequential FIGS. 5-8. Referring to FIG. 5, an embodiment of the invention is slid over two fingers 12, 14 of one hand 16 as shown. Ribbon 101 is passed through the fingers and held in position, clear of the tying fingers, by ribbon retainers 103 and 105 positioned in ribbon retainer slots 107 and 109. The invention can be used in this manner over any one or more fingers and can also mount on another support structure such as a stanchion in a tying station, or a tank stand, or a caddy leg, or a waist belt device.

Figure 6:
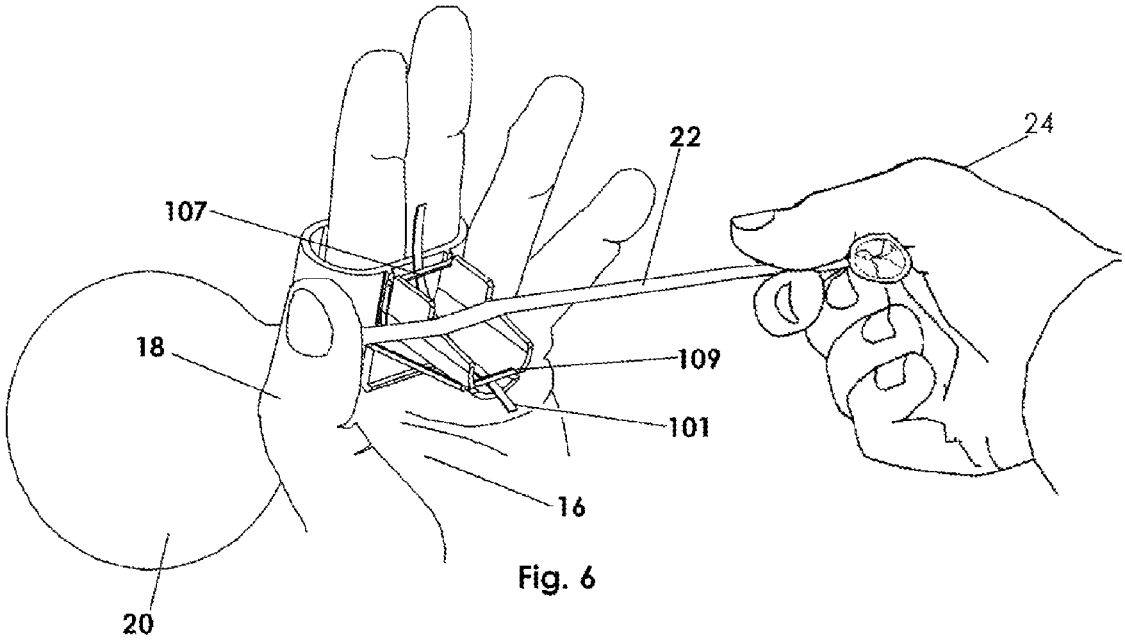
Figure 7:
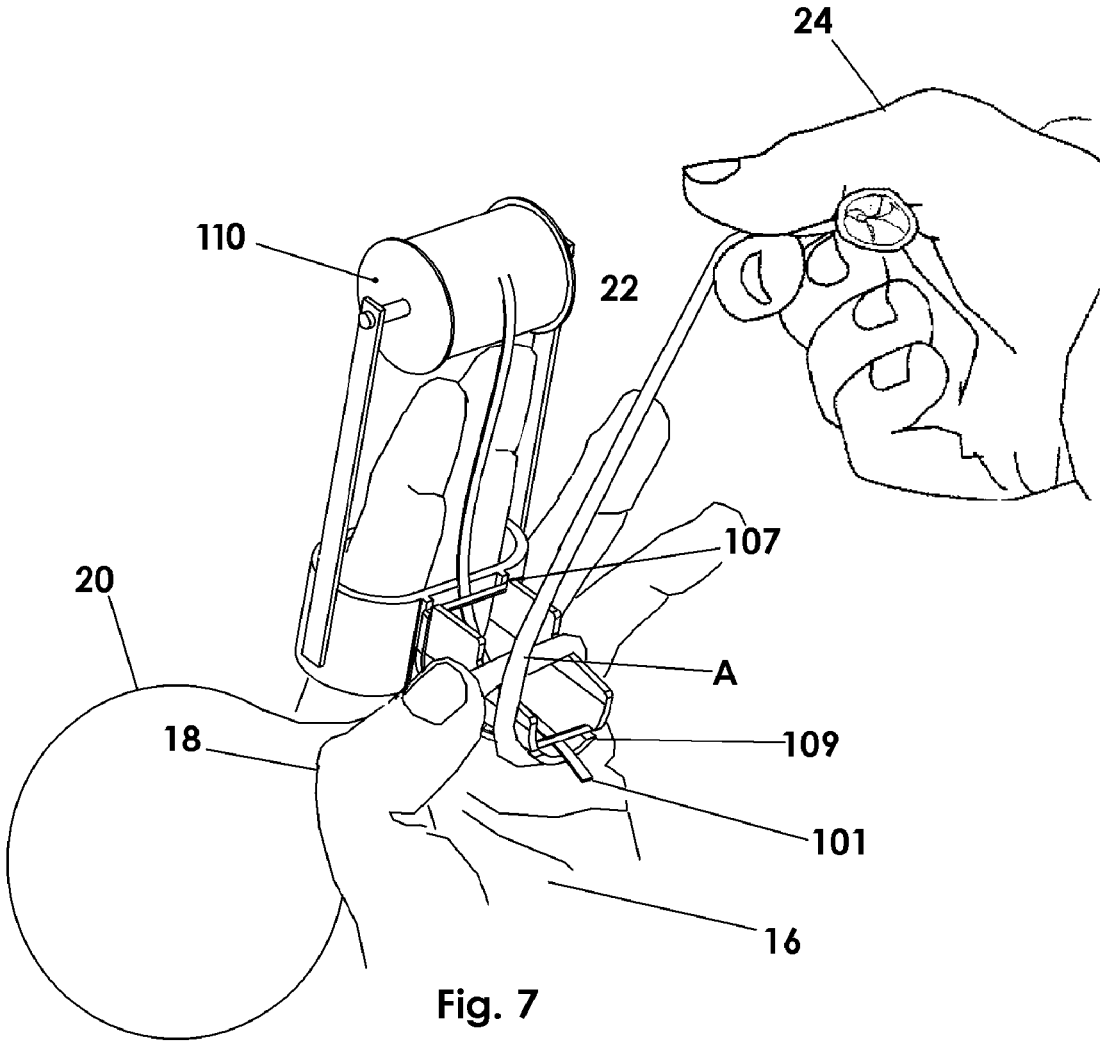

Referring next to FIGS. 6 and 7, an inflated balloon 20 is held with the thumb 18 of the one hand 16, whilst the open end 22 thereof is stretched across the two holding edges 9 just distally of the retaining edges 11. Then the open end 22 is wrapped around the cantilever 5 until it crosses over itself at point A. Additionally, a ribbon spool 110 can be mounted on the base to feed spooled ribbon 101 through the axially oriented recess 17.

Figure 8:
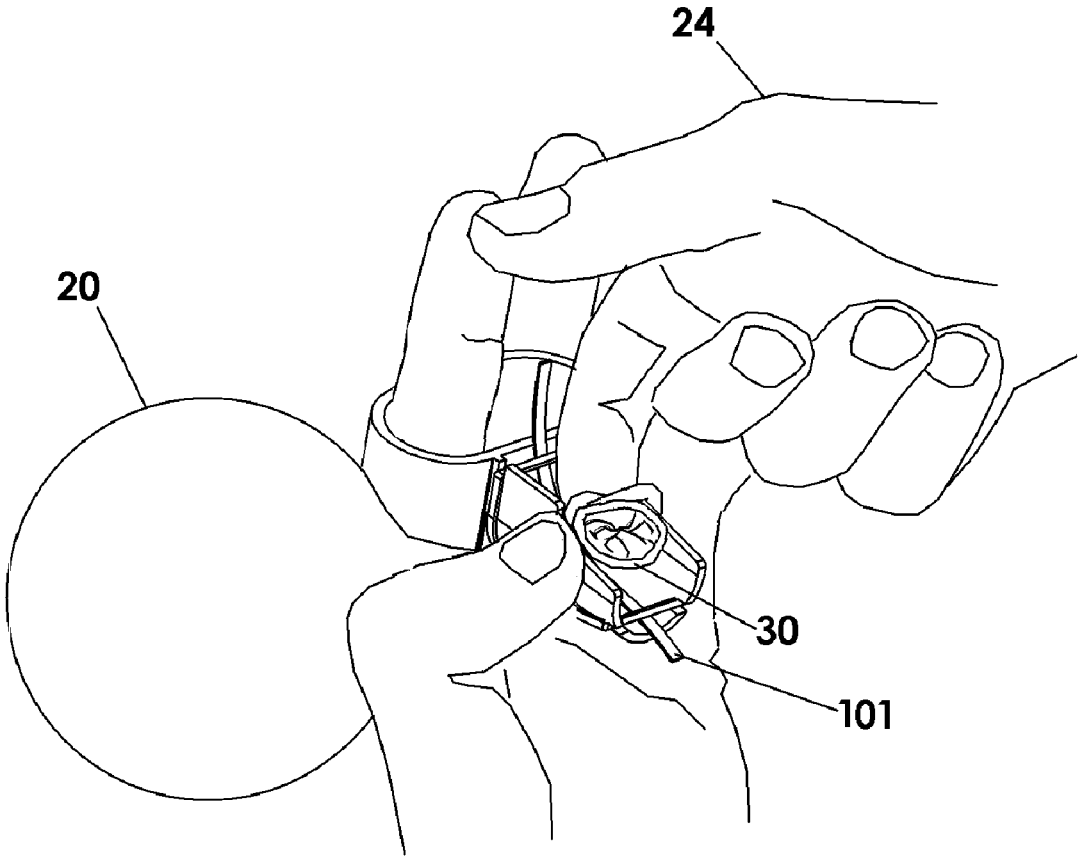

Referring next to FIG. 8, the open end is passed under itself, then upwardly through the recess 17, forming a half-hitch knot 30 around the cantilever 5. The knot 30 is then easily slid distally off the cantilever 5 with the ribbon positioned integral with the knot 30. The knot is rapidly pulled to tightness to complete the half-hitch knot with integral ribbon in the balloon to seal the same and hold compressed air or gas therein. This enables tying a balloon archway having a continuous ribbon through multiple balloons or having individual ribbons for each balloon. The knot can also be tied by crossing under itself and downwardly through the recess 17.

Figure 9:
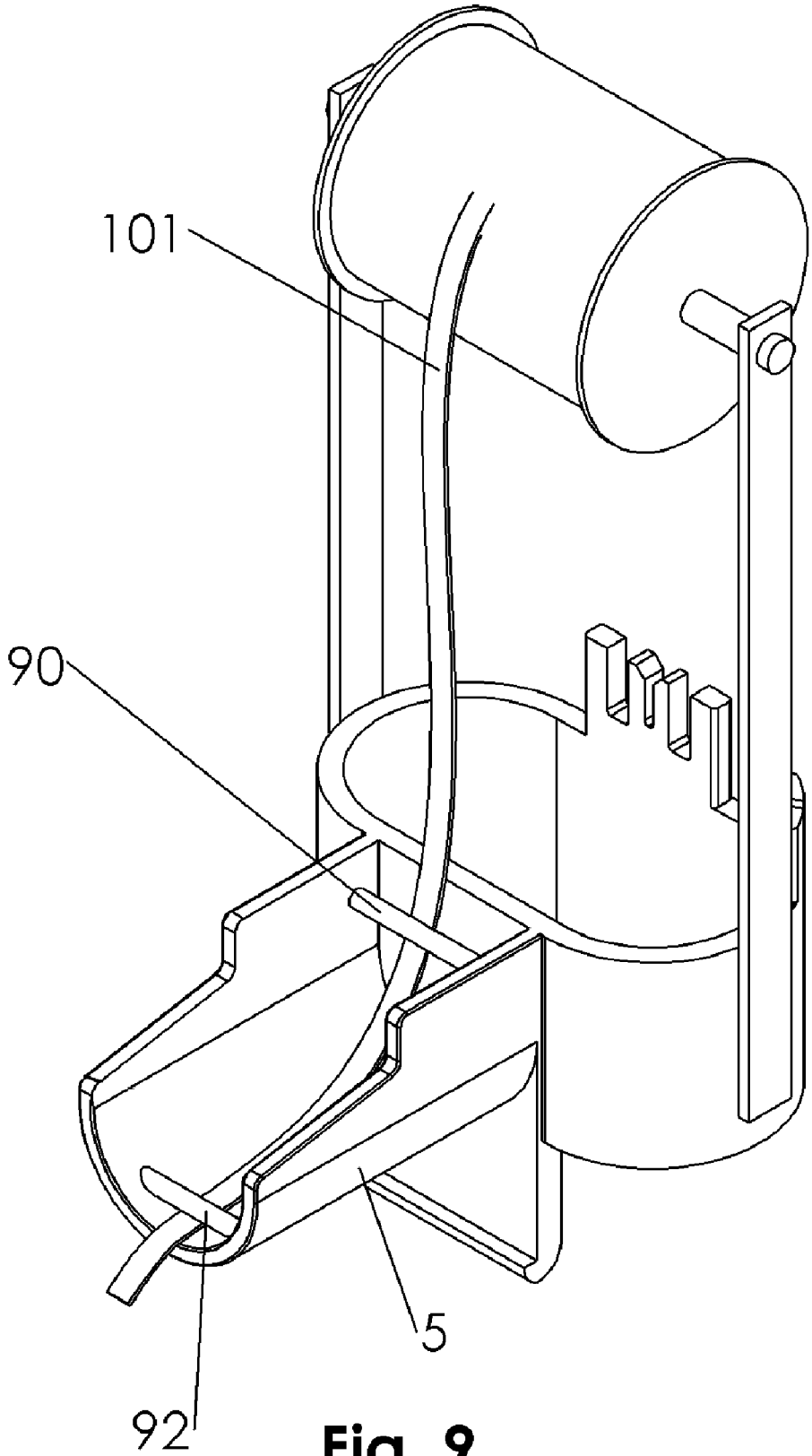
FIG. 9 is an isometric view of a second embodiment of the invention using spooled ribbon.

FIG. 9 is an isometric view of a second embodiment of the invention preferably used for tying balloons to spooled ribbon 101. Instead of using bands to retain the ribbon, two pins are removably disposed in the recess 17 of the cantilever 5. A proximal pin 90 is removably disposed in the cantilever proximal region and a distal pin 92 is removably disposed in the cantilever distal region. Spooled ribbon 101 is fed beneath the pins and remains in the lower quadrant of the recess 17 to clear way for tying the knot in a balloon. Spooled ribbon can be continuously fed through the device thereby enabling multiple balloons to be integrated on the same length of ribbon for use in balloon arches.

Figure 10:
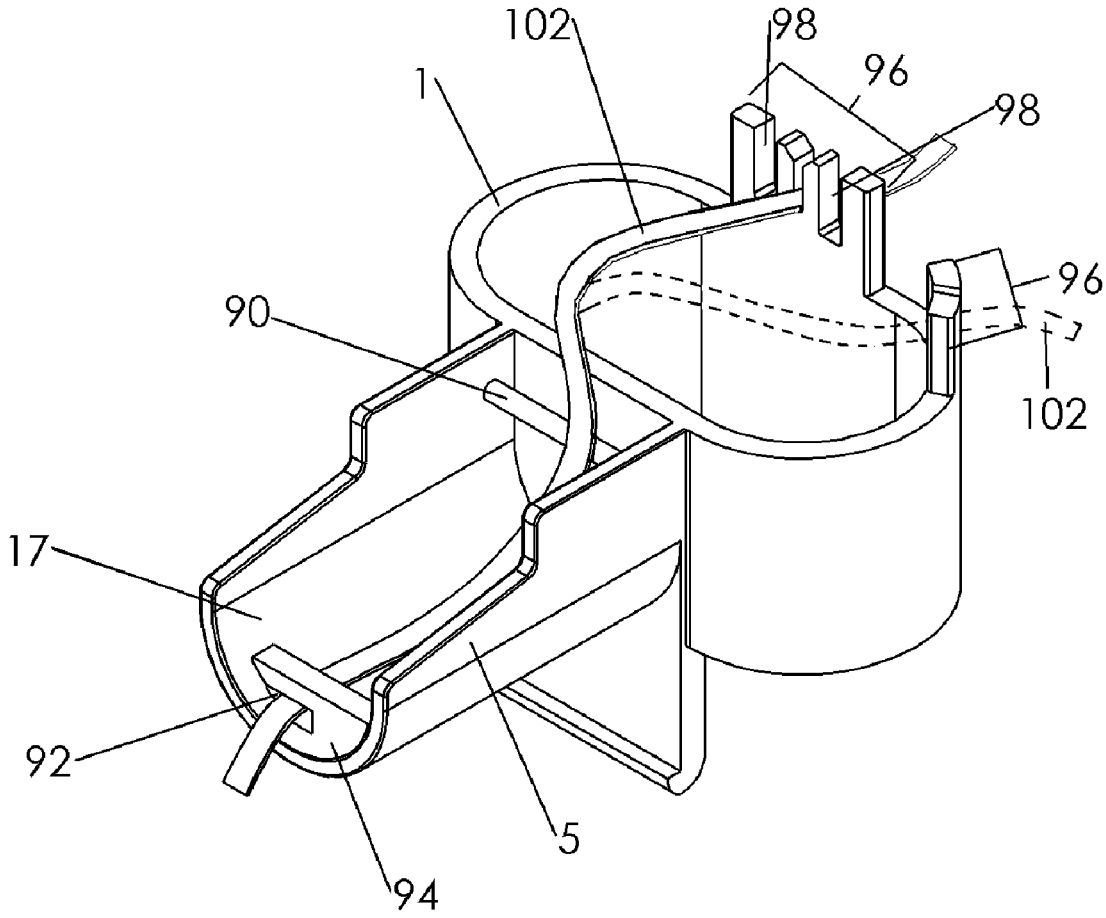
FIG. 10 is an isometric view of a third embodiment of the invention using pre-cut ribbon.
Figure 11:
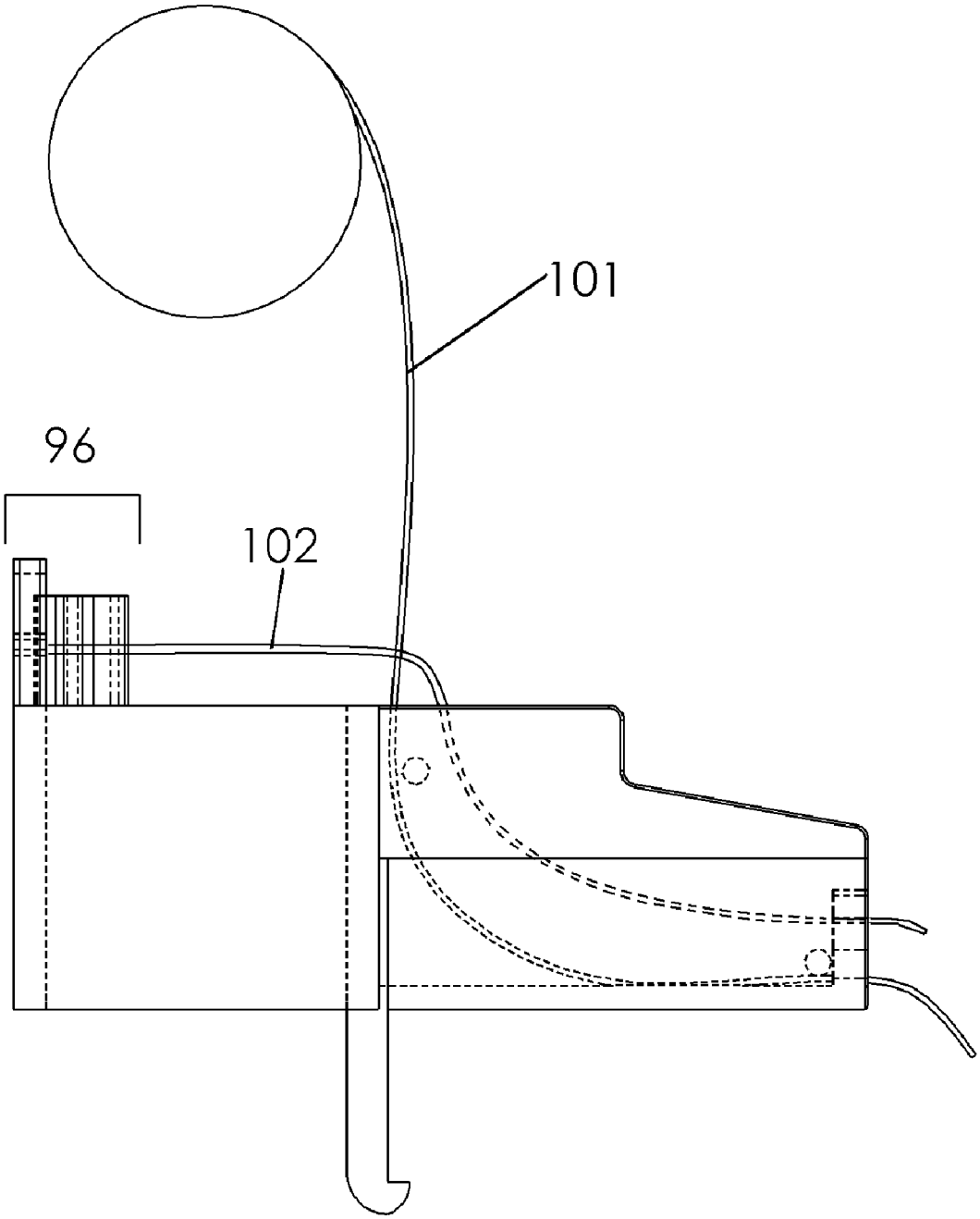
FIG. 11 is a side view showing the feed path of the spooled and pre-cut ribbon.
Figure 12:
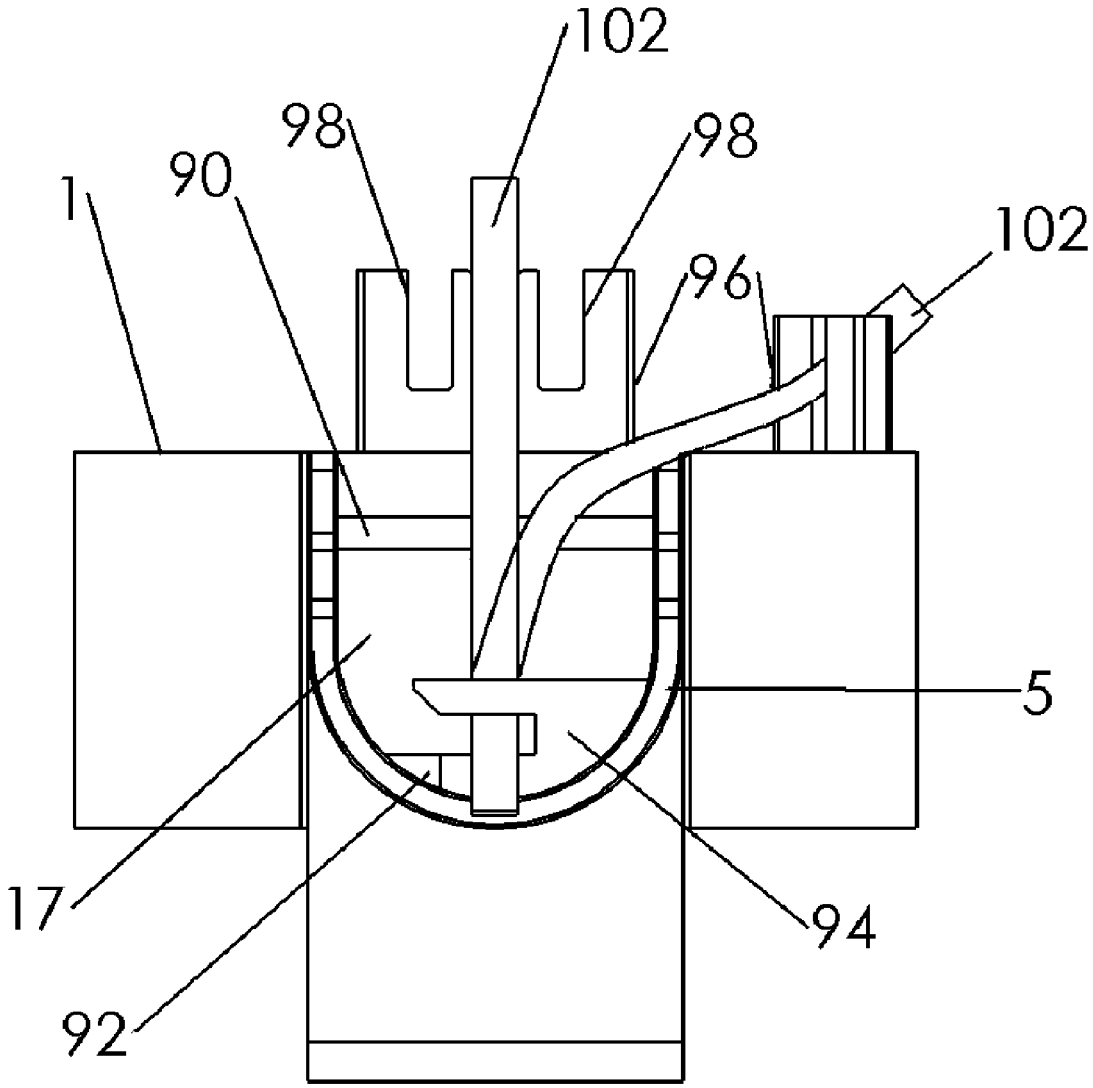
FIG. 12 is a front view of the invention using pre-cut ribbon.

FIG. 10 is an isometric view of a third embodiment of the invention preferably used for tying balloons to pre-cut ribbons of any length, preferably between 2 and 6 feet. A distal ribbon guide 94 is removably disposed in the distal cantilever region, preferably by snapping the guide's rear lip projection under the distal pin 92 for a press fit. The proximal pin 90 is not used with pre-cut ribbon. A proximal ribbon guide 96 is disposed on the upper edge of the base 1. The center portion of the proximal ribbon guide has two mounting slots 98 that can be used to mount the device to a support structure. If the support structure blocks the center portion of the proximal ribbon guide 96 a side portion of the proximal ribbon guide 96 can be used to guide the pre-cut ribbon into the recess 17. Other tying operations are common to all embodiments.

Figure 13:
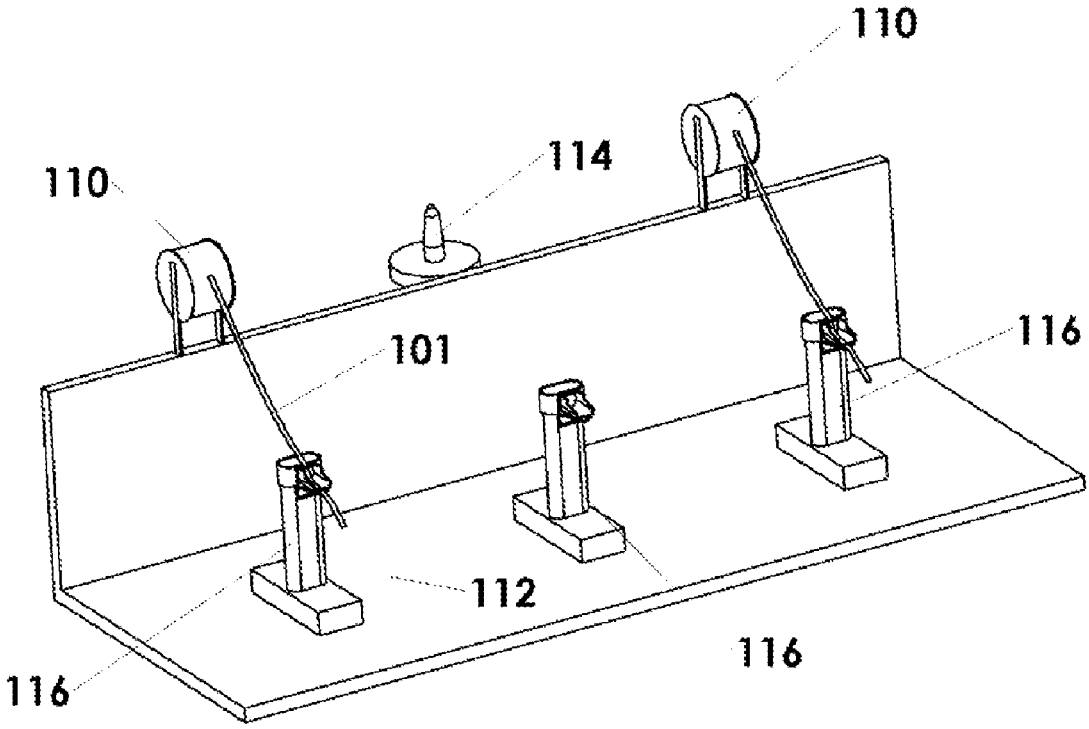
FIG. 13 is an isometric view of the invention mounted in a tying station and using spooled ribbon with three stanchion stations and the balloon gas nozzle.

FIG. 13 shows an embodiment of the invention in a tying station 112 that allows users to travel to parties and such for tying the balloons on-site. Station stanchions 116 are removably disposed on the station 112 as support structure for the tyers. A balloon gas nozzle 114 is removably disposed on the tying station 112. A separate gas bottle (not shown) supplies balloon gas to the gas nozzle. The tying station folds to a suitcase-like container that holds the tying devices, stanchions, and other accessories for safe transport and opens at the job site for quick setup.

Figure 14:
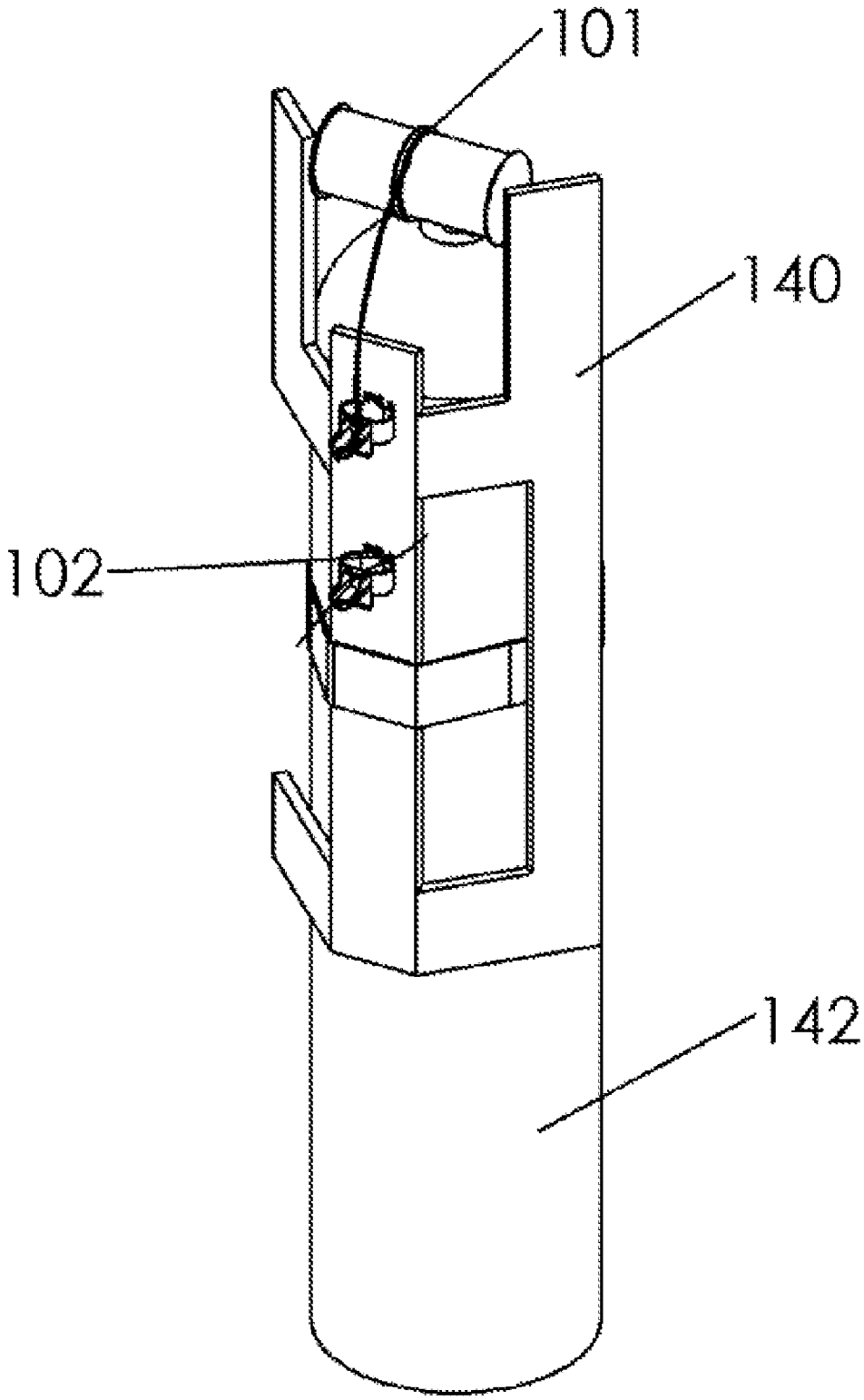
FIG. 14 is an isometric of the invention mounted on a gas tank stand with ribbon spools.
Figure 15:
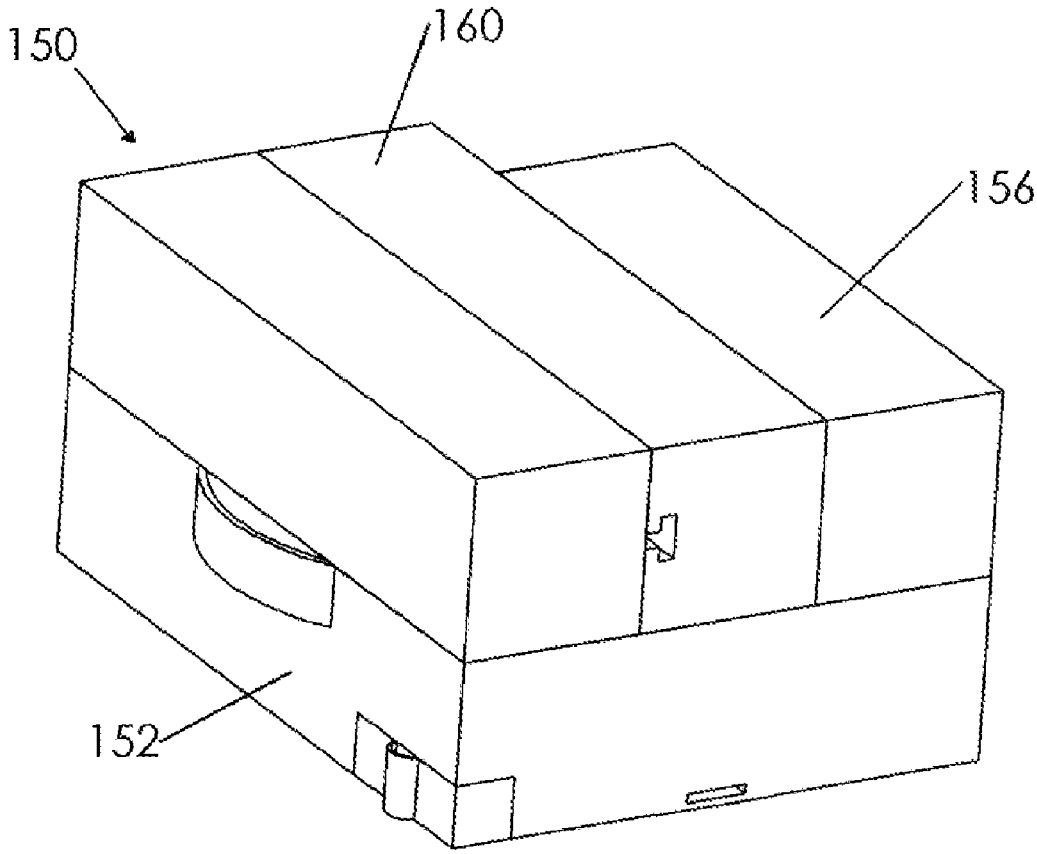
FIG. 15 is an isometric view of the caddy in a closed or packed condition.
Figure 16:
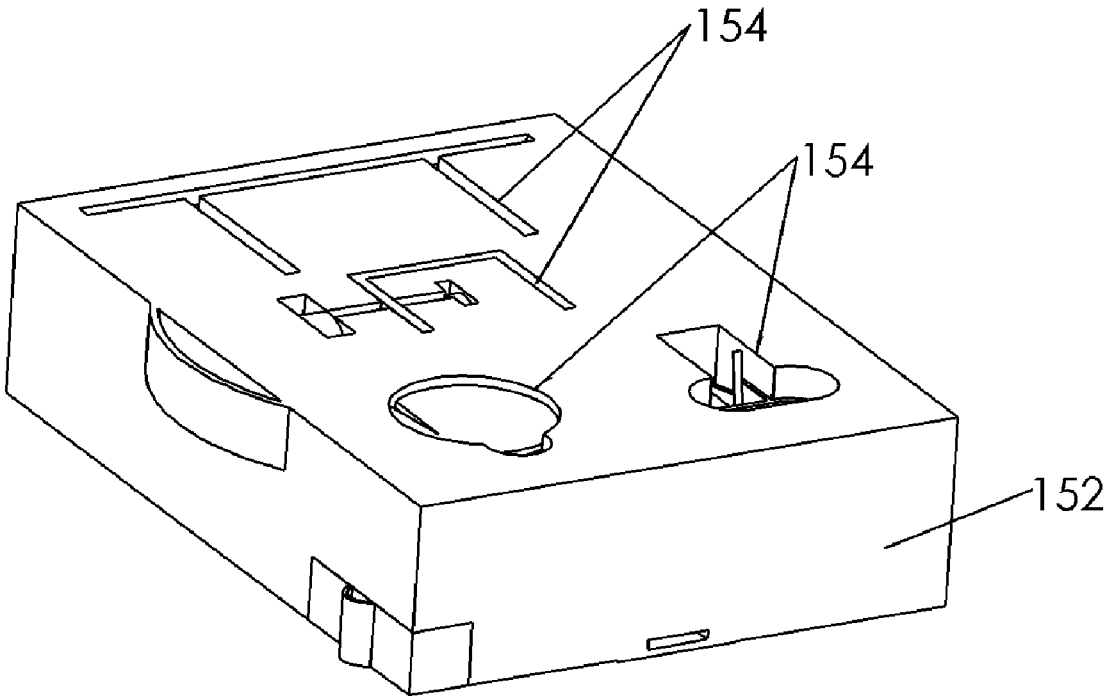
FIG. 16 is an isometric of the caddy base showing the cutouts for accessories.
Figure 17:
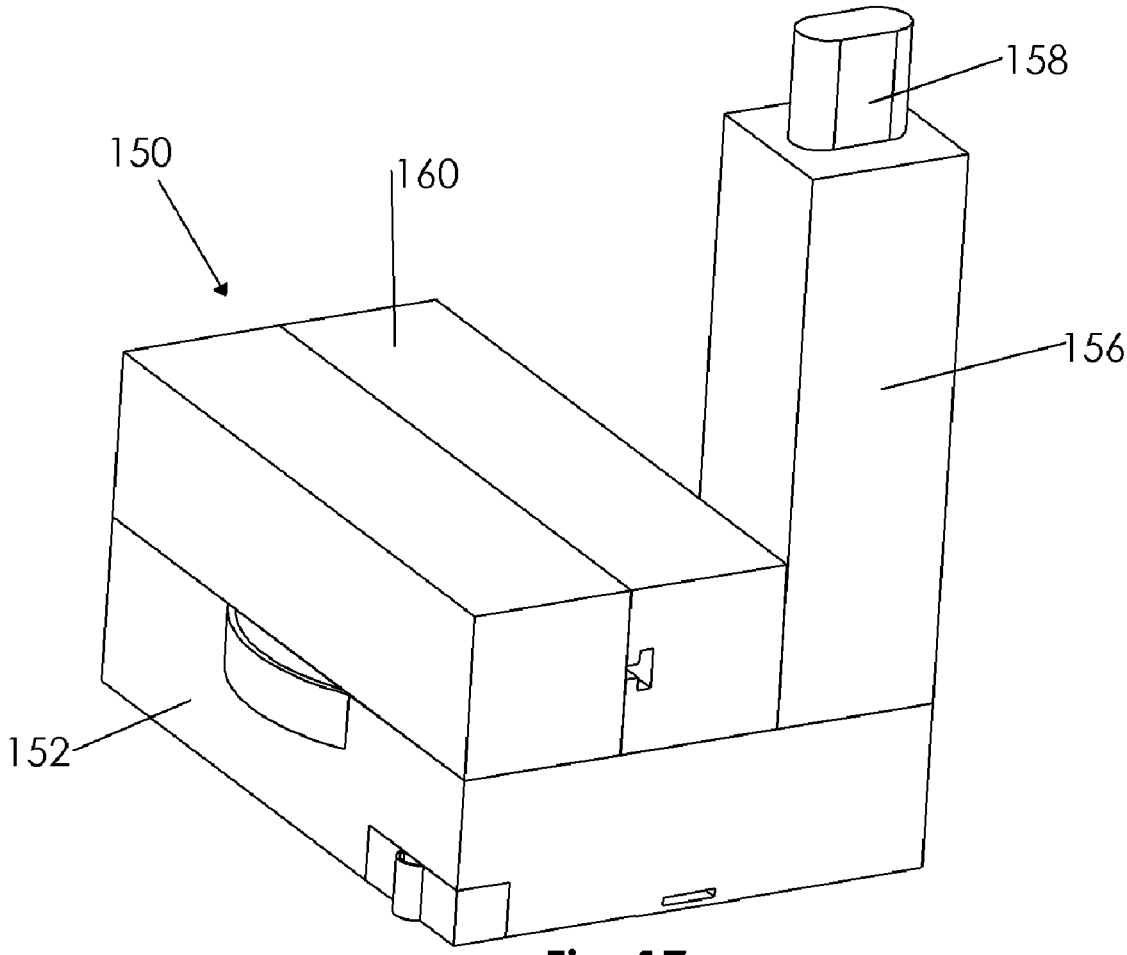
FIG. 17 is an isometric of the caddy with the first folding leg extended.
Figure 18:
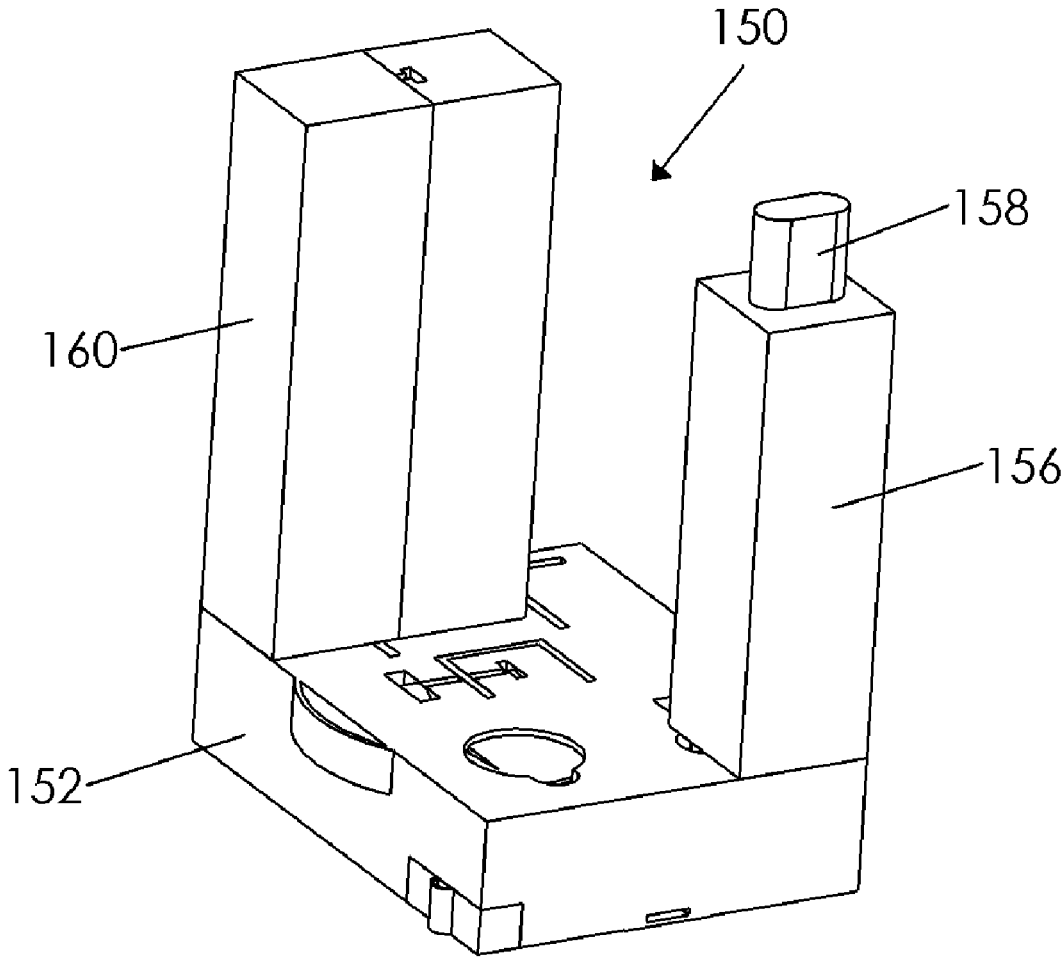
FIG. 18 is an isometric of the caddy in an intermediate folded state.
Figure 19:
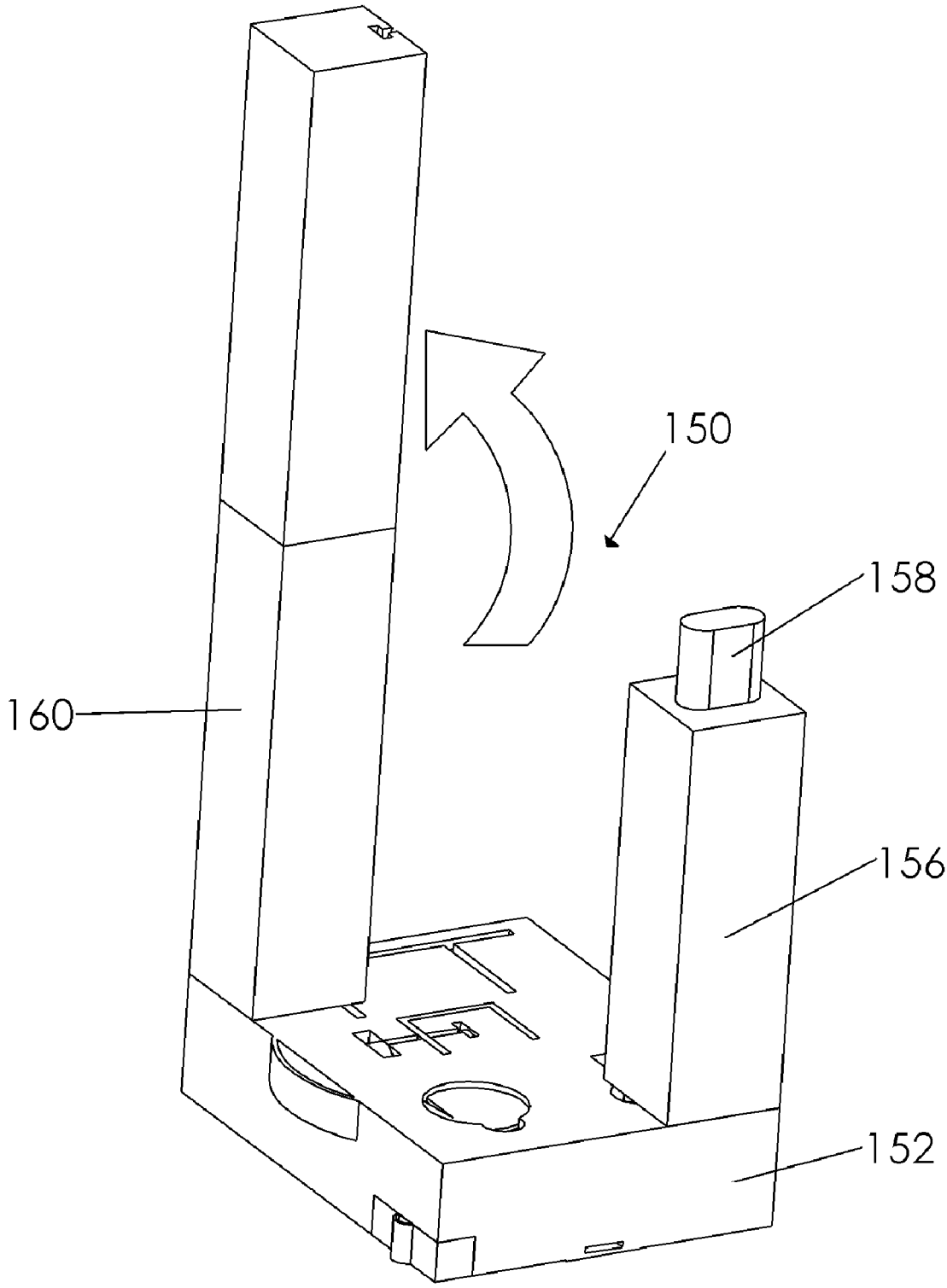
FIG. 19 is an isometric of the caddy in a fully unfolded state.
Figure 20:
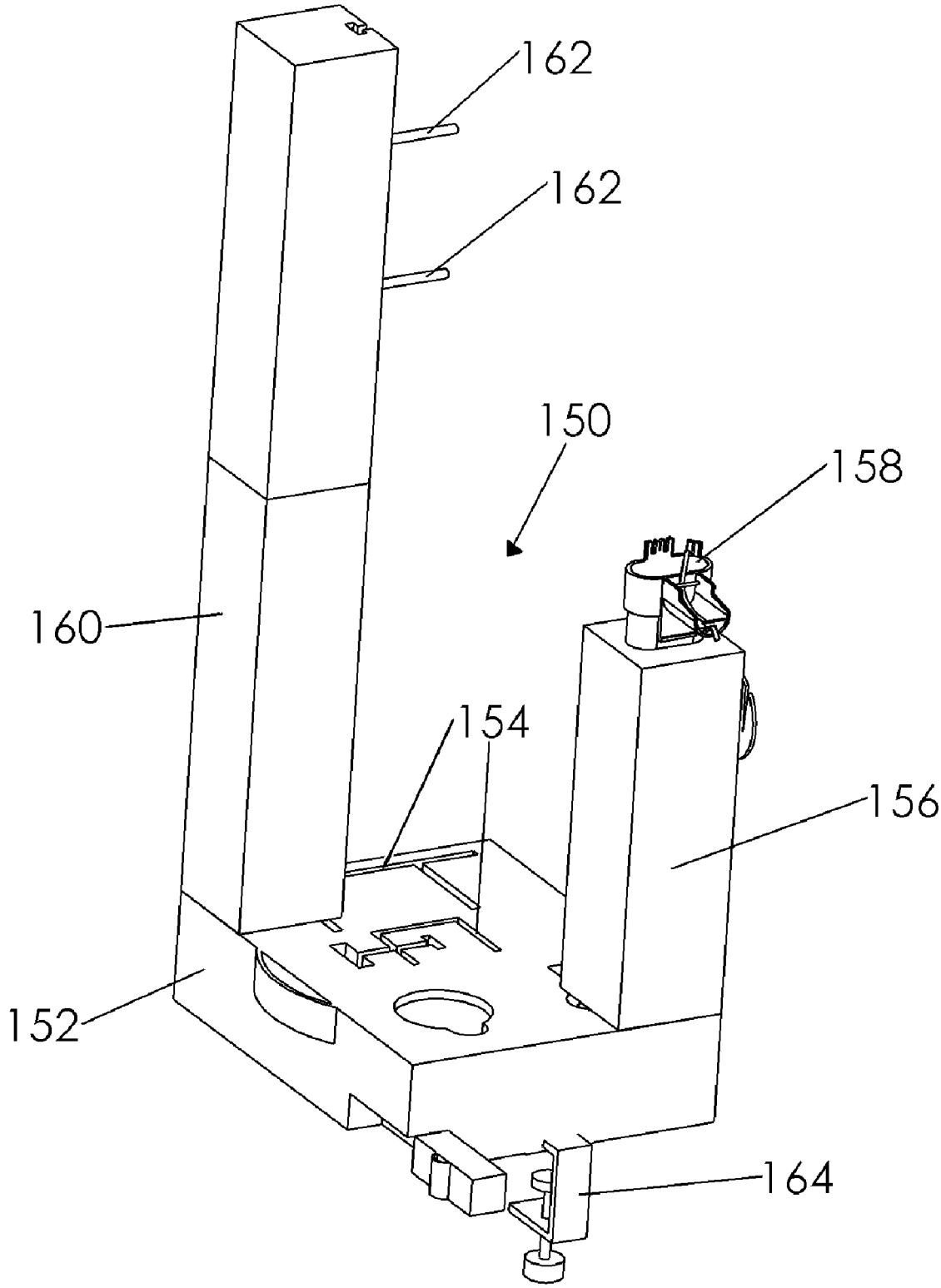
FIG. 20 is an isometric of the caddy with ribbon spools and tying devices mounted.

FIG. 14 shows another embodiment of the invention. A tank stand 140 support structure is removably disposed on a balloon gas tank 142 with at least one tying device removably mounted to the tank stand 140. Spooled ribbon 101 and pre-cut ribbon 102 can be used in this embodiment, and used for balloon tying in a similar manner to other embodiments.

FIGS. 15-20 show another embodiment of the invention that uses a folding caddy 150 as support structure for the tying devices. A caddy base 152 has tying accessory storage cutouts 154 used for storing necessary tying accessories. A first folding caddy leg 156 serves as support structure for a tying device 158. A second folding caddy leg 160 supports at least one ribbon spool stand 162. A clamp 164 removably mounts the caddy to a table (not shown). Balloon tying operations are similar to other embodiments.

Another embodiment of the invention uses a waist belt or the like as support structure for the tying device. This enables wearing the balloon tyer at waist level for walking to various locations and immediately tying balloons on the spot.

While there has been shown and described what are at present considered the preferred embodiments of the invention, it will be obvious to those skilled in the art that various changes and modifications can be made therein without departing from the scope.

The invention claimed is:

1. A balloon tying device comprising:

a base adapted for attaching to a support structure; and a cantilever supported by said base and protruding away from the support structure, said cantilever having a U-shaped cross section, said cantilever having a proximal region closest to said base and a distal region, said proximal region having two ears defining generally parallel planes extending outwardly therefrom, each of said ears terminating in a distal retaining edge for retaining a loop of balloon material, said cantilever defining inside said U-shape an axially oriented recess, said recess extending from said proximal region and between said ears to said distal region; and a brace tab extending downward from the lower edge of said base; and a ribbon retainer disposed on said device, said ribbon retainer further comprising a proximal ribbon retaining section and a distal ribbon retaining section.

2. A balloon tying device in accordance with claim 1 wherein said support structure is selected from the group consisting of at least two human fingers, a station stanchion, a tank stand, and a caddy leg.

3. A balloon tying device in accordance with claim 2 wherein the bottom edge of said brace tab is curled.

4. A balloon tying device in accordance with claim 2 wherein said proximal ribbon retaining section further comprises a band disposed in slots positioned in said cantilever proximal region and said distal ribbon retaining section further comprises a band disposed in slots positioned in said cantilever distal region.

5. A balloon tying device in accordance with claim 2 wherein said proximal ribbon retaining section further comprises a proximal pin disposed in said cantilever proximal region and said distal ribbon retaining section further comprises a distal pin disposed in said cantilever distal region.

6. A balloon tying device in accordance with claim 5 wherein said proximal ribbon retaining section further comprises a proximal ribbon guide disposed on the upper edge of said base and said distal ribbon retaining section further comprises a distal ribbon guide disposed in said cantilever distal region.

7. A balloon tying device in accordance with claim 6 wherein said proximal ribbon guide further comprises at least one mounting tab, at least one straight-feed slot, and at least one side-feed slot.

8. A balloon tying device in accordance with claim 7 wherein said distal ribbon guide further comprises a distal slot insert removably coupled to said distal pin in said cantilever distal region.

9. A balloon tying device of claim 8 further comprising a ribbon spool stand disposed on said base.

10. A balloon tying device of claim 8 wherein said device is disposed on at least one station stanchion, said station stanchion further disposed on a tying station, said tying station further comprising at least one ribbon spool stand.

11. A balloon tying device of claim 8 wherein said device is disposed on a tank stand, said tank stand further disposed on a gas tank, said tank stand further comprising at least one ribbon spool stand.

12. A balloon tying device of claim 8 wherein said device is disposed on a tyer folding leg of a caddy, said caddy further comprising a caddy base and at least one ribbon spool stand disposed on a ribbon folding leg, said caddy base further comprising tying accessory storage cutouts.

* * * * *